US008235158B2

(12) United States Patent
Su

(10) Patent No.: US 8,235,158 B2
(45) Date of Patent: Aug. 7, 2012

(54) ELECTRONIC DEVICE HAVING WHEELS AND WHEEL THEREOF

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 426 days.

(21) Appl. No.: 12/623,453

(22) Filed: Nov. 23, 2009

(65) Prior Publication Data

US 2010/0178844 A1 Jul. 15, 2010

(30) Foreign Application Priority Data

Jan. 13, 2009 (CN) ..... 2009 1 0300169

(51) Int. Cl.
*B60K 23/08* (2006.01)
*B60K 7/00* (2006.01)
*A63H 17/26* (2006.01)

(52) U.S. Cl. ..... 180/247; 180/62; 192/74; 192/49

(58) Field of Classification Search ..... 180/247, 180/244, 62, 63; 192/49, 71, 74, 84.8, 84.9, 192/84.92, 69.4, 69.42, 69.62, 69.63, 69.9, 192/69.91; 301/5.306, 87
See application file for complete search history.

(56) References Cited

U.S. PATENT DOCUMENTS 1,046,995 A * 12/1912 Deiller et al. ..... 192/76
* cited by examiner

*Primary Examiner* — Paul N Dickson
*Assistant Examiner* — Wesley Potter
(74) *Attorney, Agent, or Firm* — Altis Law Group, Inc.

(57) ABSTRACT

A wheel includes a main body, a tire, a movable fixing pin, an electromagnet, and an elastic member. The tire is sleeved on the main body and defines a fixing hole. The tire is operable to rotate around the main body. The fixing pin is operable to be inserted into the fixing hole to fix the tire to the main body. The electromagnet is operable to attract the fixing pin to separate the fixing pin from the tire when the electromagnet is powered on. The elastic member is disposed between the electromagnet and the fixing ping, and pushes the fixing pin into the fixing hole when the electromagnet is powered off.

12 Claims, 4 Drawing Sheets

ELECTRONIC DEVICE HAVING WHEELS AND WHEEL THEREOF

BACKGROUND

1. Technical Field

The present disclosure relates to electronic devices, and particularly to an electronic device with wheels.

2. Description of Related Art

Some motor driven electronic devices, such as toy cars, usually have wheels that are driven synchronously, as such, maneuvering of the electronic device is difficult. To solve this problem, each wheel can be independently driven by a corresponding motor. However, the cost of the electronic device would be greatly increased.

Therefore, it is desirable to provide an electronic device having wheels which can overcome the above-mentioned problems.

BRIEF DESCRIPTION OF THE DRAWINGS

The components of the drawings are not necessarily drawn to scale, the emphasis instead being placed upon clearly illustrating the principles of the embodiments of an electronic device. Moreover, in the drawings, like reference numerals designate corresponding parts throughout several views.

DETAILED DESCRIPTION

Embodiments of the present disclosure will now be described in detail with reference to the drawings.

Figure 1:
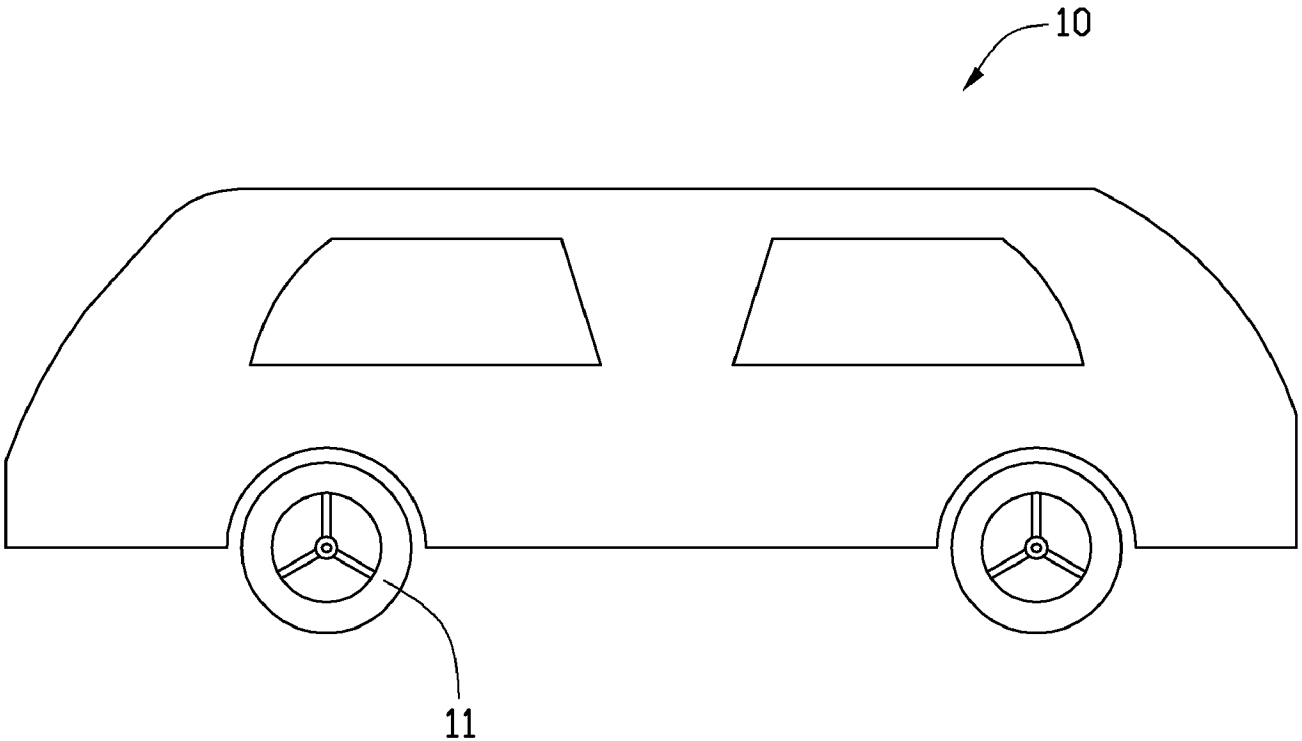
FIG. 1 is an isometric view of an electronic device, according to an exemplary embodiment.
Figure 2:
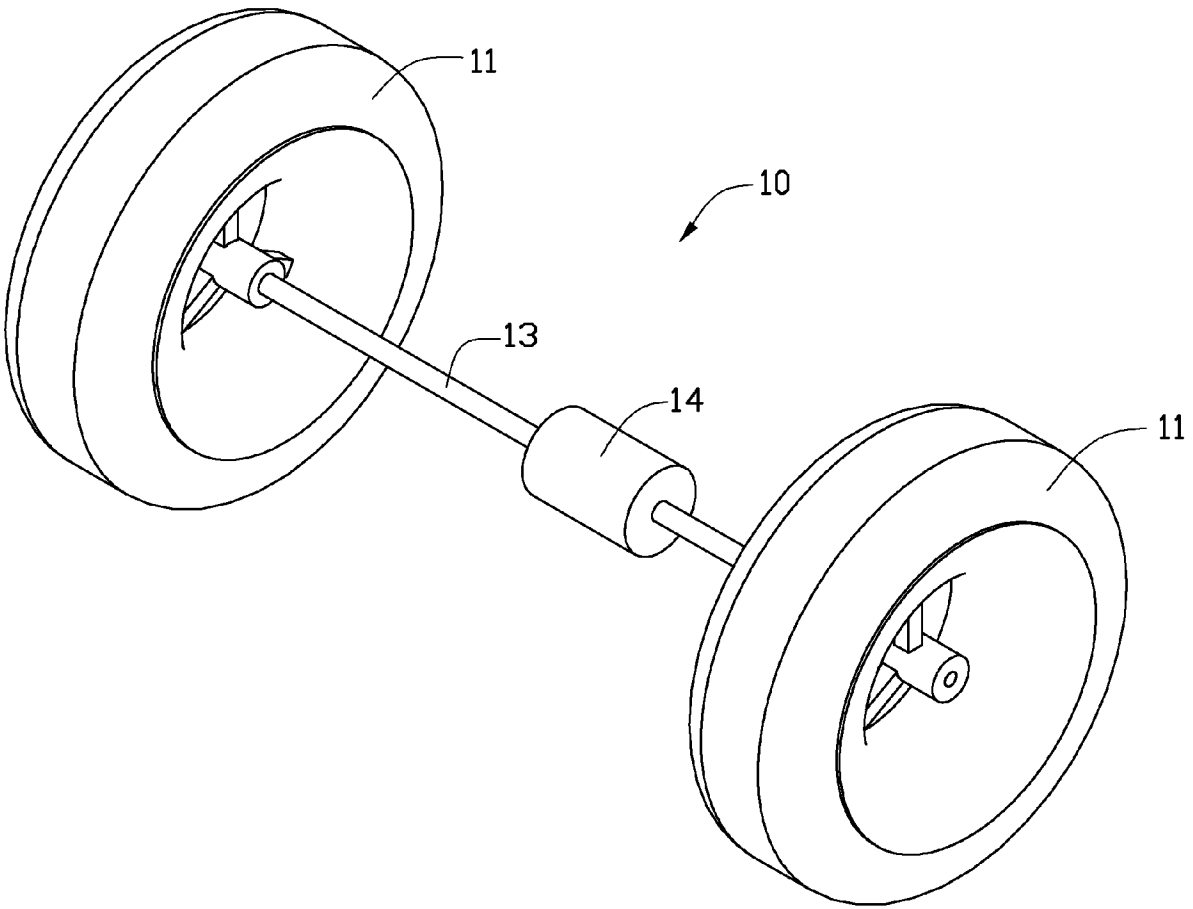
FIG. 2 is two connecting wheels of the electronic device of FIG. 1.
Figure 3:
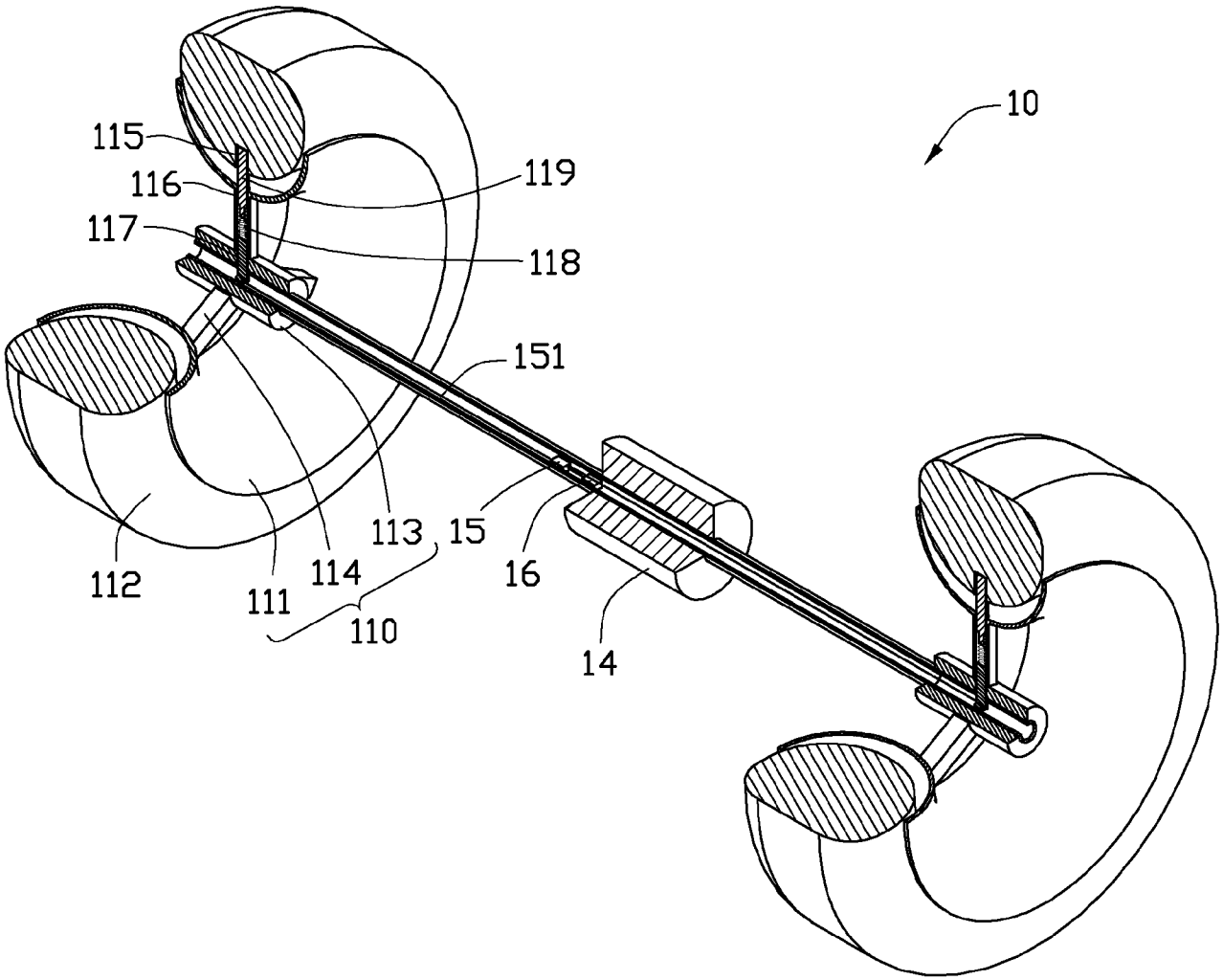
FIG. 3 is a sectional view of the two connecting wheels of FIG. 2 in a first state.
Figure 4:
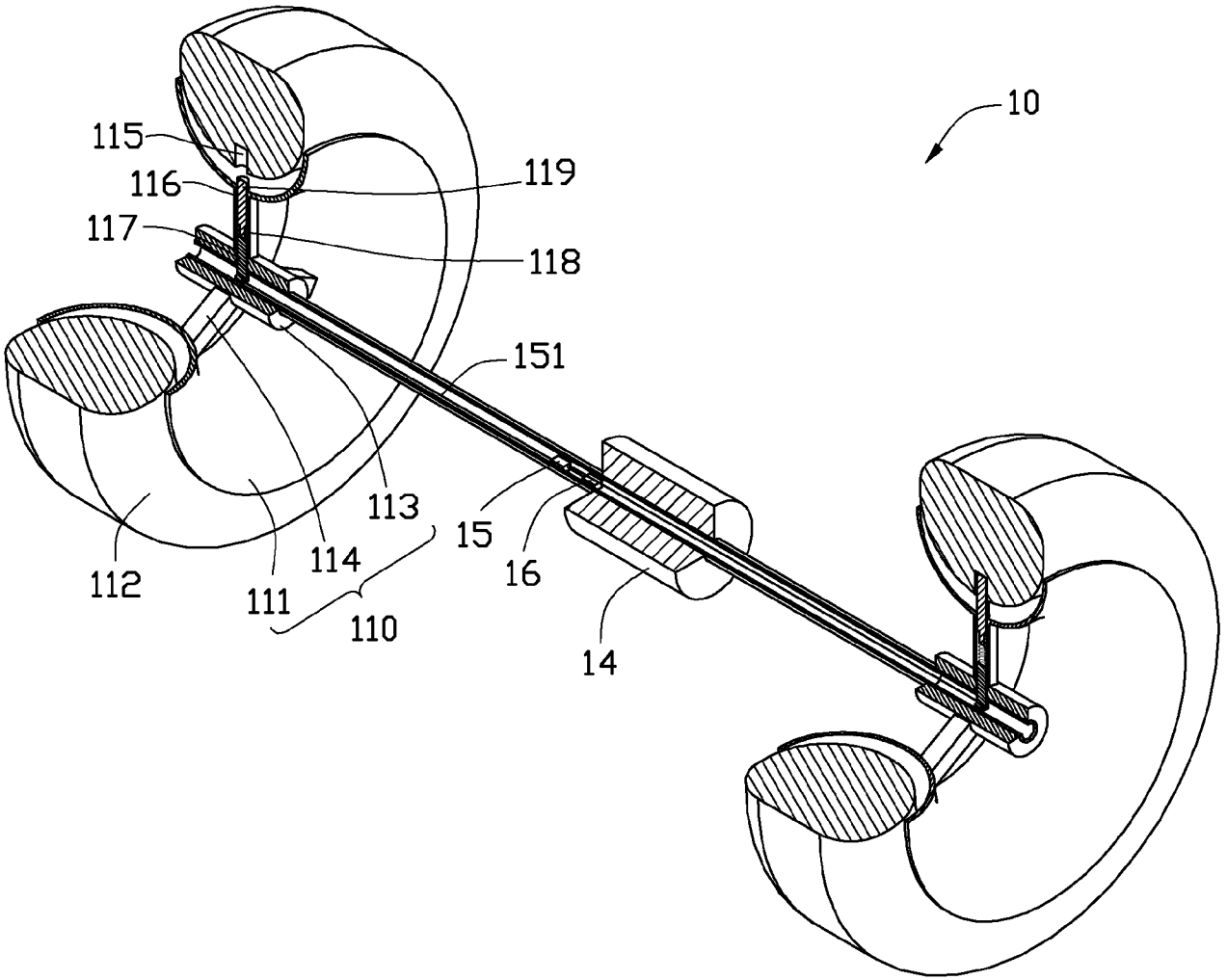
FIG. 4 is a sectional view of the two connecting wheels of FIG. 2 in a second state

Referring to FIGS. 1-3, an electronic device 10, according to an exemplary embodiment, includes at least two wheels 11, at least one axle 13 interconnecting the at least two wheels 11, a driver 14 for driving the axle 13, a power supply module 15, and a controlling module 16. In this embodiment, the electronic device 10 is a toy car.

Each of the wheels 11 includes a rim 111, a tire 112 sleeved on the rim 111, a hub 113 located in a center of the rim 111, and a number of spokes 114 connecting the rim 111 and the hub 113. The rim 111, the hub 113, and the spokes 114 constitute a main body 110 of the wheel 11. The rim 111 is circular and has a concave outer surface. The tire 112 is circular and sleeved on the outer surface of the rim 111. The tire 112 defines a fixing hole 115 facing the outer periphery of the rim 111. The hub 113 is a hollow cylinder. One end of each spokes 114 is perpendicularly fixed on the hub 113, and the other end is fixed on an inner surface of the rim 111 opposite to the outer surface.

Each of the wheels 11 further defines a through hole 116 through the hub 113, one of the spokes 114, and the rim 111. Each of the wheel 11 further includes an electromagnet 117, an elastic member 118, and a fixing pin 119. The electromagnet 117, the elastic member 118, and the fixing pin 119 are received in the through hole 116. One end of the electromagnet 117 is fixed on the hub 113. The elastic member 118 is disposed between the electromagnet 117 and the fixing pin 119. The fixing pin 119 is a magnet or can be made of a ferromagnetic material such as iron. When the electromagnet 117 is powered on, the electromagnet 117 attracts the fixing pin 119. Accordingly, the fixing pin 119 moves toward the electromagnet 117, and therefore the elastic member 118 is compressed. When the electromagnet 117 is powered off, the electromagnet 117 does not apply an attracting force to the fixing pin 119, such that the fixing pin 119 is pushed into the fixing hole 115 by the compressed elastic member 118. As a result, the tire 112 cannot rotate relative to the rim 111.

The axle 13 is tubular. Opposite ends of the axle 13 are fixed in the two hubs 113 correspondingly. The driver 14 is connected to the axle 13 for driving the axle 13 to rotate. In practice, the driver 14 is fixed to a main body (not shown) of the electronic device 10, and the axle 13 can rotate relative to the driver 14. The power supply module 15 is received in the axle 13 and electrically connected to the two electromagnets 117 via wires 151. The power supply module 15 is operable to supply power to the electromagnets 117 to power on the electromagnets 117. The processor 16 is also disposed in the axle 13 and electrically connected to the power supply module 15. The processor 16 is operable to control the power supply module 15 to supply power to the electromagnets 117.

When the electronic device 10 moves in a straight line, the processor 16 controls the power supply module 15 to stop supplying power to the two electromagnets 117, such that the two electromagnets 117 are powered off. Accordingly, the two fixing pins 119 are pushed into the fixing holes 115 by the compressed elastic member 118 so as to fix the tires 112 to the rims 111. Thereby, the tires 112 rotate with the rims 111 and the axle 13 synchronously, and the two wheels 11 have the same speed.

Also referring to FIG. 3, for the electronic device 10 to turn, the processor 16 controls the power supply module 15 to supply power to one of the two electromagnets 117, such that one of the two electromagnets 117 is powered off, and the other electromagnet 117 is powered on. As such, the power-on electromagnet 117 applies an attracting force to a corresponding fixing pin 119, which is large enough to overcome the resisting force applied by the compressed elastic member 118. Accordingly, the fixing pin 119 moves close to the power-on the electromagnet 117, and separates from the fixing hole 115. Thereby, the rim 111 and the axle 13 corresponding to the power-on electromagnet 117 rotate relative to the tire 112, and the rotational speed of the corresponding wheel 11 decreases to about zero. Due to the difference of the rotational speeds of the two wheels 11, the electronic device 10 turns around at the wheel 11 whose electromagnet 117 is powered on.

To stop the electronic device 10, the processor 16 controls the power supply module 15 to supply power to both of the two electromagnets 117. Thereby, the two fixing pins 119 separate from the two fixing holes 115. The rims 111 and the axle 13 rotate relative to the tires 112 correspondingly, and the rotational speed of the two wheels 11 decreases to about zero accordingly.

It should be mentioned that the electromagnet 117 also can be fixed on the spoke 114 where the electromagnet 117 is received in an alternative embodiment.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. An electronic device, comprising:

at least one axle;

at least one pair of wheels fixed to two opposite end of the at least one axle, each wheel comprising:

a main body;

a tire sleeved on the main body, the tire defining a fixing hole therein, the tire being operable to rotate around the main body;

a movable fixing pin operable to be inserted into the fixing hole to fix the tire to the main body;

an electromagnet operable to attract the fixing pin to separate the fixing pin from the tire when the at least one electromagnet is powered on; and an elastic member disposed between the electromagnet and the fixing pin, the elastic member being operable to push the fixing pin into the fixing hole when the electromagnet is powered off;

a driver connected to the at least one axle, the driver being operable to drive the at least one axle to rotate;

a power supply module electrically connected to the electromagnets for supplying power to the electromagnets; and a processor for controlling the power supply module to supply power to the electromagnets, the processor being operable to control the power supply module to stop supplying power to the electromagnets in a first manner, and control the power supply module to supply power to one of the electromagnets in a second manner.

2. The electronic device of claim 1, wherein the processor is further operable to control the power supply module to supply power to all of the electromagnets in a third manner, so as to stop the electronic device.

3. The electronic device of claim 1, wherein the main body comprises:

a rim for sleeving the tire;

a hub located in a center of the rim, the hub being fixed to one end of the at least one axle; and at least two spokes connecting the hub and the rim.

4. The electronic device of claim 3, wherein each of the at least one pair of wheels defines a through hole through the rim, one of the at least two spokes and the hub, the through hole faces the fixing hole, the fixing pin, the elastic member and the electromagnet are received in the through hole.

5. The electronic device of claim 3, wherein the electromagnet is fixed to one of the hub and the at least two spokes.

6. The electronic device of claim 1, wherein the axle is tubular, the power supply module is received in the axle.

7. The electronic device of claim 1, wherein the fixing pin comprises a magnet or a ferromagnet.

8. A wheel, comprising:

a main body;

a tire sleeved on the main body, the tire defining a fixing hole therein, the tire being operable to rotate around the main body;

a movable fixing pin operable to be inserted into the fixing hole to fix the tire to the main body;

an electromagnet operable to attract the fixing pin to separate the fixing pin from the tire when the electromagnet is powered on; and an elastic member disposed between the electromagnet and the fixing pin, the elastic member being operable to push the fixing pin into the fixing hole when the electromagnet is powered off.

9. The wheel of claim 8, wherein the main body comprises:

a rim for sleeving the tire;

a hub located in a center of the rim; and at least two spokes connecting the hub and the rim.

10. The wheel of claim 9, further defining a through hole through the rim, one of the at least two spokes and the hub, the through hole faces the fixing hole, the fixing pin, the elastic member and the electromagnet are received in the through hole.

11. The wheel of claim 9, wherein the electromagnet is fixed to one of the hub and the at least two spokes.

12. The wheel of claim 8, wherein the fixing pin comprises a magnet or a ferromagnet.

* * * * *